US005355830A

United States Patent [19]

deJong

[11] Patent Number: 5,355,830

[45] Date of Patent: Oct. 18, 1994

[54] RECHARGEABLE AIR HORN AND METHOD OF USING THE SAME

[76] Inventor: Michael deJong, 719 Yonge St., Ste. 205, Toronto, Canada

[21] Appl. No.: 953,519

[22] Filed: Sep. 29, 1992

[51] Int. Cl.[5] ..... G10K 9/04

[52] U.S. Cl. ..... 116/142 FP; 116/DIG. 19

[58] Field of Search ..... 116/137 R, 142 R, 142 FP, 116/DIG. 18, DIG. 19

[56] References Cited

U.S. PATENT DOCUMENTS

| | | | |
|---|---|---|---|
| 620,958 | 3/1899 | Pierman | 116/137 R |
| 1,614,858 | 1/1927 | Wenz | 116/142 FP |
| 2,619,931 | 12/1952 | Mueller | 116/137 R |
| 2,660,973 | 12/1953 | Porttance | 116/137 R |
| 2,778,330 | 1/1957 | Jacoby | 116/137 R |
| 2,793,651 | 5/1957 | Gomez | 116/137 R |
| 3,670,690 | 6/1972 | Swanson | 116/142 FP |
| 3,785,335 | 1/1974 | Wagner | 116/112 |
| 4,171,678 | 10/1979 | Palm | 116/142 |
| 4,185,670 | 1/1980 | Sartell, Jr. | 116/137 R |
| 4,970,983 | 11/1990 | LeBlanc et al. | 116/142 |
| 4,998,499 | 3/1991 | Nordbeck | 116/142 |
| 5,022,790 | 6/1991 | Stevenson | 405/186 |
| 5,106,236 | 4/1992 | Hancock et al. | 405/186 |

FOREIGN PATENT DOCUMENTS

| | | | |
|---|---|---|---|
| 0443563 | 12/1948 | Italy | 116/137 R |

*Primary Examiner*—William A. Cuchlinski, Jr.
*Assistant Examiner*—John L. Beres
*Attorney, Agent, or Firm*—Hill, Steadman & Simpson

[57] ABSTRACT

An air horn and method of using such a horn is rechargeable by a conventional air pump for use when the air, acting as a propellant, is depleted from its container connected to the horn. The device may be connected to a bicycle or may be used, for example, on a boat. The device is sounded by depressing an activator or an actuator which releases air into a membrane of the horn to vibrate a diaphragm. When air is depleted from the container, an adapter having an inlet valve connected thereto permits connection of a conventional pump or a built-in pump for refilling.

18 Claims, 3 Drawing Sheets

RECHARGEABLE AIR HORN AND METHOD OF USING THE SAME

The present invention is related to commonly assigned, copending U.S. patent application having U.S. Ser. No. 07/963,642 filed Oct. 20, 1992, the disclosure of which is herein incorporated by reference in its entirety.

BACKGROUND OF THE INVENTION

The present invention generally relates to an aerosol type device for sounding a horn to be used on a boat, attached to a bicycle, hand-operated personal use, or the like. More specifically, the invention relates to a device in which a container is filled with compressed air which may be released by a user to sound the horn.

Furthermore, the present invention relates to a horn which may be repetitively filled with compressed air by pumping air using a conventional tire pump, built-in pump or the like, into the container.

Horns are known in the prior art connected to a container generally containing chemical gases which act as a propellant. Such horns are generally shown and described in U.S. Pat. Nos. 3,785,335 and 4,970,983.

Chemical gases which are used as a propellant in a horn, however, require cooling in order to change the gases to a liquid state. A safety hazard results when sounding the horn since the gases often flow out in a liquid state. As a result, a user may potentially suffer from frost bite when the liquid contacts his body. This may be especially prevalent when the container is not held in a vertical, upright position.

In addition, chemically propelled horns when sounded repetitively over a short time span may stop working as a result of cold gases freezing a membrane of the horn. Narrow air passages may cause pressure of the gases flowing through the entire unit to decrease as well. Therefore, the reliability of the horn for repetitive use over a short time span is hampered.

Another drawback of chemically propelled horns is they may only operate in temperatures above 33° F. Finally, known chemically propelled horns typically use chlorofluoro-carbon (CFC) as a propellant which when dispensed from the horn are destructive to the ozone layer. Other "friendlier" gases to the environment are also known for use in chemically propelled horns but are typically highly flammable and, therefore, extremely dangerous.

In addition, these known horns are not capable of being refilled for reuse. Instead, when the gases are depleted from the container, the container must be thrown away and replaced or often the entire horn assembly may require replacement.

SUMMARY OF THE INVENTION

The present invention provides an air horn which overcomes the deficiencies of known prior art horns. The air horn sprays air from a chamber through a channel which vibrates a diaphragm in a membrane to sound the horn. The container includes a chamber which may be repetitively refilled after the air has been depleted therefrom.

In an embodiment, an adapter having an opening is connected to a single open end of a chamber for connection therebetween. The adapter has a second opposite opening defining a passageway therethrough. A third opening transverse to the passageway connects an inlet valve to the adapter. The inlet valve may be connected to a conventional tire pump or a built-in pump for refilling the chamber when it has been emptied. An outlet valve is secured to the second opening of the adapter providing a passageway to the membrane of the horn wherein a diaphragm vibrates to sound the horn. The outlet valve may be depressed by an activator to release air from the chamber to the membrane for vibration of the diaphragm.

Additional features and advantages of the present invention are described, and will be apparent from, the detailed description of the presently preferred embodiments and from the drawings.

DETAILED DESCRIPTION OF THE PRESENTLY PREFERRED EMBODIMENTS

Figure 1:
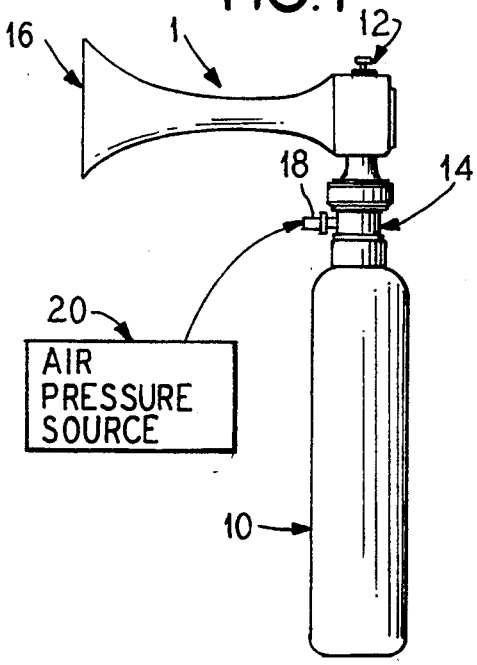
FIG. 1 is a side-elevational view of a rechargeable air horn for connection to an air pressure source.

In accordance with the invention described with reference to the accompanying figures wherein like numerals designate like parts, a system 1 is provided for dispensing compressed air stored within a chamber 10 by depressing an activator 12 forcing the air stored within the chamber 10 through an adapter 14 and finally through a horn 16. A one-way air inlet valve 18 is connected to an opening in the sidewall of the adapter 14 for refilling of air into the chamber 10 using a conventional air pressure source 20. The system is shown as described in FIG. 1.

Figure 2:
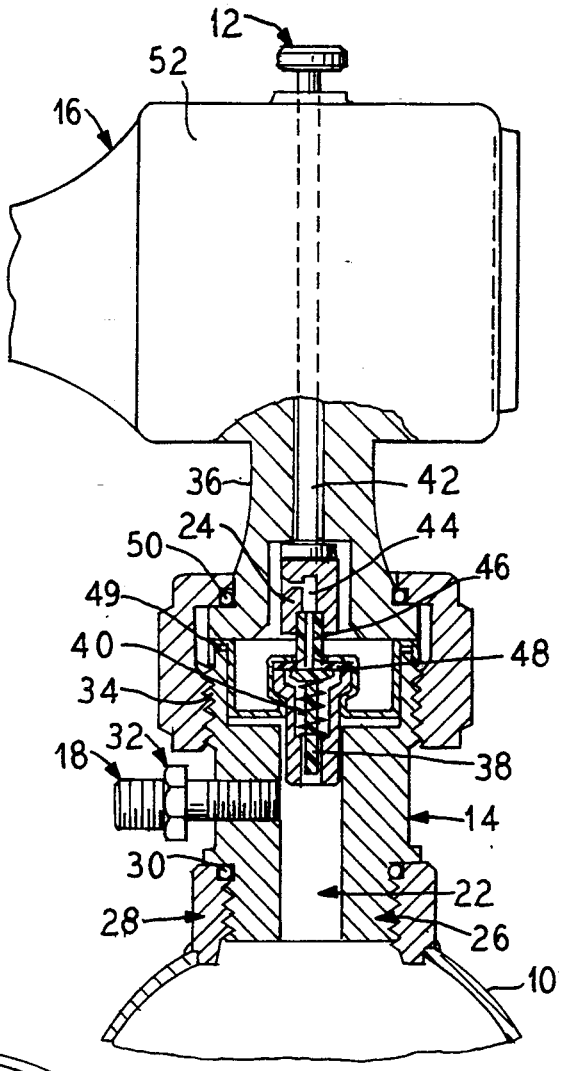
FIG. 2 is a cross-sectional view of an inlet valve, an outlet valve, an adapter and an activator as connected between the horn and chamber of the present invention.

FIG. 2 is an enlarged, cross-sectional view of the connecting elements between the horn 16 and the chamber 10. As illustrated, the adapter 14 has a vertical passageway 22 substantially extending between the chamber 10 and the outlet valve components generally shown at 24. The adapter 14 has an externally threaded open lower end 26 connected to an internally threaded open end 28 of the chamber 10. An O-ring 30 provides sealed engagement therebetween.

Through a sidewall of the adapter 14 is connected the air inlet valve 18 in threaded engagement. The inlet valve 18 extends to the vertical passageway 22 of the adapter 14 for air to be supplied to the chamber 10. The air inlet valve 18 is a standard one-way valve having opposite threaded ends separated by a hexagonal nut 32. The opposite open end 34 of the adapter 14 may be threadably connected to the neck 36 of the horn 16 with the outlet valve components 24 operatively connected therebetween.

The outlet valve components 24 include a plunger 38 biased by a spring such that when the activator 12 is depressed, the plunger 38 depresses allowing release of air from the chamber 10 to be forced through a vertical channel 42 of the neck 36 into the horn 16. The valve components 24 include a stopping mechanism 44 which depresses vertical channel member 46 which in turn depresses the plunger 38. The stopping mechanism 44, therefore, limits the amount in which the plunger 38 may be depressed. The spring 40 is biased to force the plunger 38 into a closed field position. A washer 48 seals the opening between the vertical channel member 46 and the plunger 38. In addition, an O-ring 50 seals the outlet valve components 24, the neck 36 of the horn 16 and the adapter 14. Finally, a second washer 49 may be crimped at the open end 34 of the adapter 14 for a sealed engagement between the adapter 14, the outlet valve components 24 and the neck 36 of the horn 16.

The horn 16 operates as is conventionally known wherein air is forced into a membrane 52 having a diaphragm (not shown) which vibrates within a chamber 52 resulting in sounding of the horn 16.

When air from the chamber 10 is depleted, the chamber 10 may be refilled by connecting the air pressure source 20, such as a conventional bike pump, tire pump, gas station pump or a built-in pump connected to the air inlet valve 18. As a result, the chamber 10 may be repetitively filled with air whenever air is depleted from the chamber 10 for sounding the horn 16.

Figure 3:
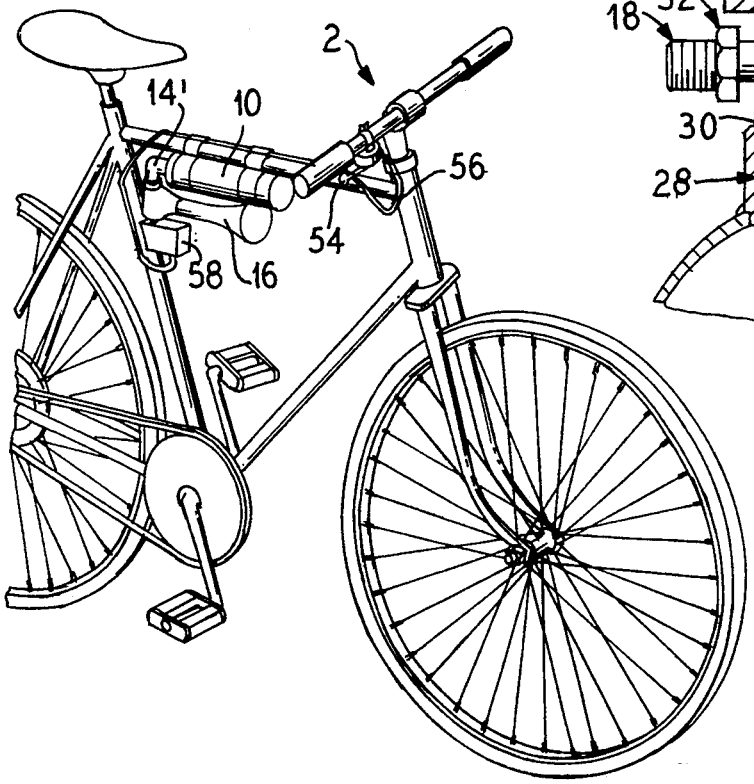
FIG. 3 is an environmental view of an embodiment of the rechargeable air horn as mounted on a bicycle.

FIG. 3 illustrates the horn 16 connected to the chamber 10 by the adapter 14' on a bicycle generally shown as 2.

Figure 4:
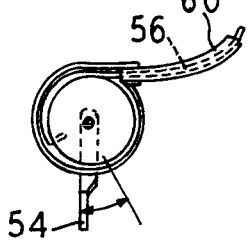
FIG. 4 is a top plan view of the activator for initiating air from the chamber for the embodiment shown in FIG. 3.

An actuator 54 connects a cable 56 to an activating mechanism, generally shown at 58. The actuator 54 as shown in specific detail in FIG. 4 is finger-actuated by pressing of the actuator 54 which is connected to the cable 56 within a casing 60. Depressing the actuator 54 provides tension of the cable 56 causing the cable 56 to pull away from the activating mechanism 58.

Figure 5:
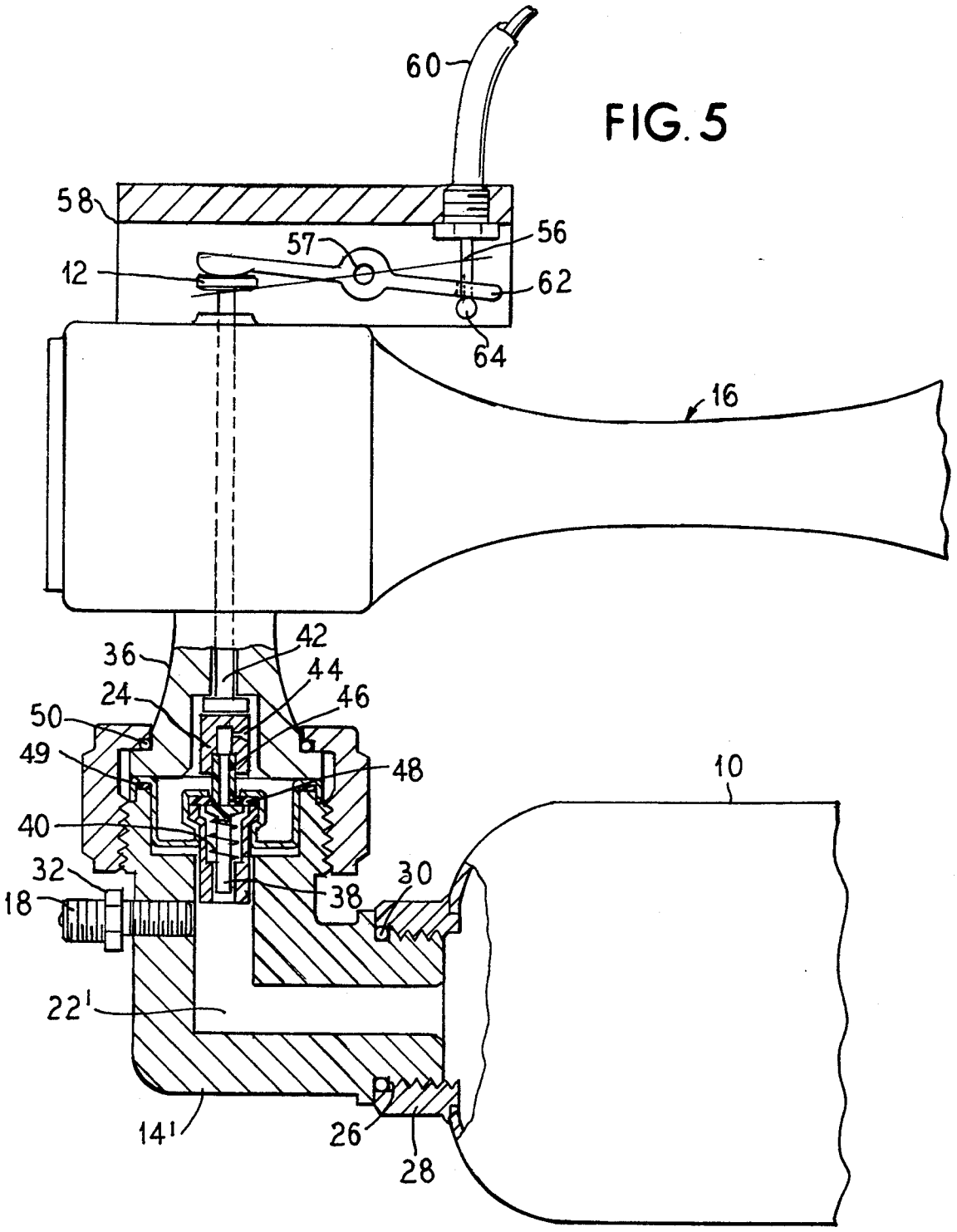
FIG. 5 is a cross-sectional view of the rechargeable air horn as shown in the embodiment of FIG. 3.

The operative components of the activating mechanism 58 are shown in detail in FIG. 5. The cable 56 is connected through a lever 62 which pivots about a fulcrum 57. The cable 56 has a stop 64 on the opposite side of the lever 62 through which the cable 56 enters. The lever 62 when the actuator 54 is pushed is pivotally mounted about the fulcrum 57 to cause the activator 12 to be depressed.

The components of the adapter 14', the outlet valve 24 and the neck 36 of the horn 12 are operatively connected substantially as discussed with reference to FIG. 2. One significant difference is that the passageway 22' between the outlet valve 24 and the chamber 10 is L-shaped to permit the chamber 10 and the horn 16 to be mounted to the bicycle in any known manner as shown in FIG. 3. That is, the chamber 10 and horn 16 are compact so as to avoid being intrusive when the bicycle 2 is being peddled by a user.

As a result of the foregoing, the chamber 10 after depletion of the air therein from repeated use of the horn 16 may be refilled as desired by attaching a pressure source to the inlet valve 18. This is particularly convenient when used on a bicycle or like vehicle in which the chamber 10 may also be filled when tires of the bicycle require refilling by an air pressure source. Pressure of up to 300 psi may be stored within the chamber 10; however, the horn 16 only requires pressure from 40 psi to 200 psi to operate. It is further contemplated to include a built-in gauge 66 (as shown in FIGS. 8 and 9) for convenient monitoring of the pressure within the chamber 10.

Figure 6:
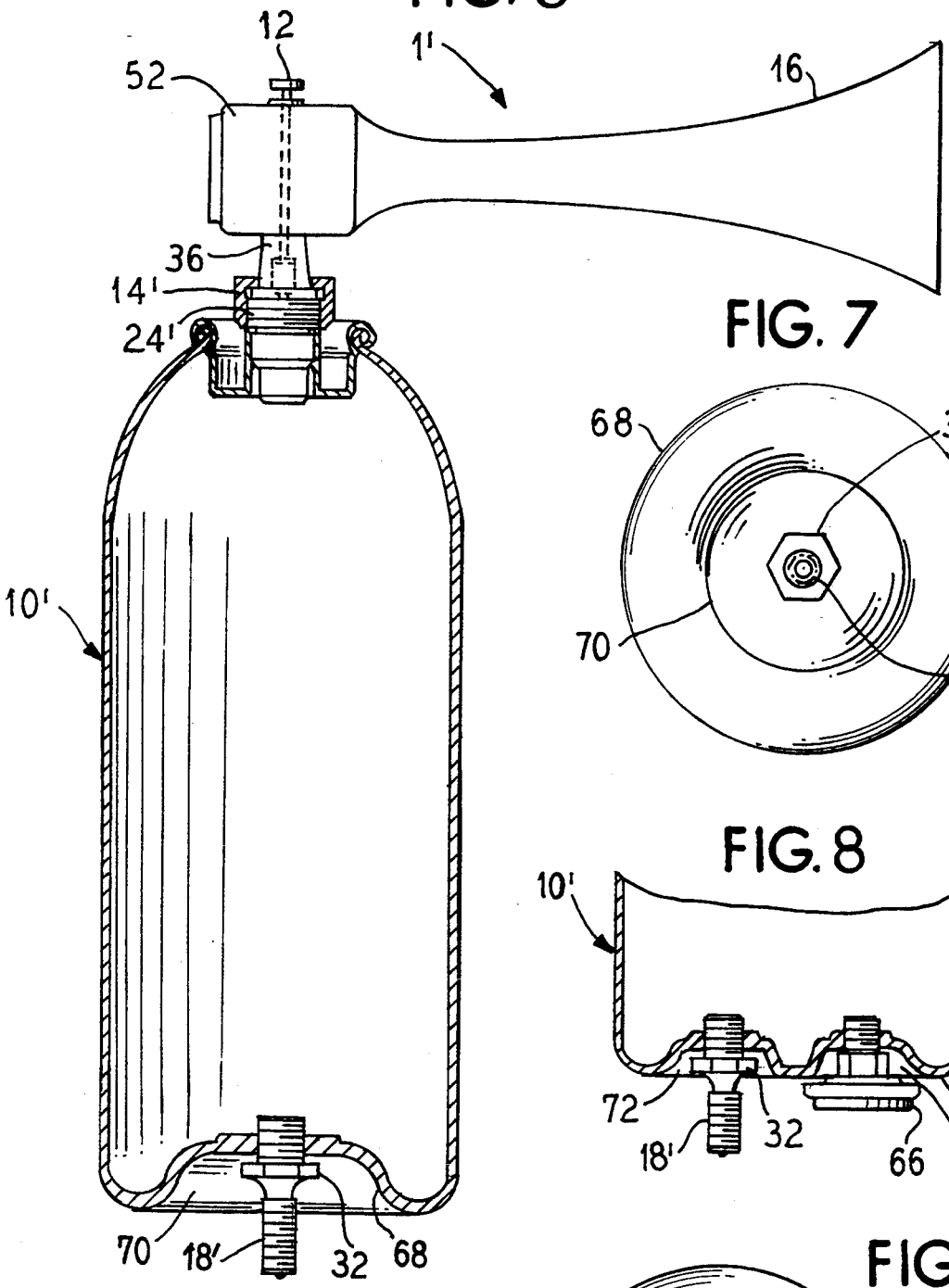
FIG. 6 is a cross-sectional view of another embodiment of a rechargeable horn of the present invention.

FIG. 6 illustrates another embodiment for a system 1' wherein like numerals designate like parts. The system 1' is distinct from the system 1 previously described with reference to FIGS. 1–5 in that an air inlet valve 18' is threadably secured at a base portion 68 of a chamber 10'. An opening is provided in the base portion 68 for threadably connecting the air inlet valve 18' in a sealed relationship to the chamber 10'. The base portion 68 has a recess portion 70 such that the chamber 10' may stand without interference from the air inlet valve 18' when a portion of its stem has been removed or a shorter inlet valve is used fitting such that it is within the recessed portion 70 of the base portion 68. An adapter 14' secures an outlet valve 44' at an opening opposite the base portion 68 of the chamber 10'. The outlet valve 24' is pushed secure under the inside of the opening and crimped in place. As a result, air may be forced to exit from the chamber 10' when the activator 12 is depressed thereby initiating air through the outlet valve 24' and into the membrane 52 to vibrate a diaphragm (not shown) thereby sounding the horn 16 of the system 1'.

Figure 7:
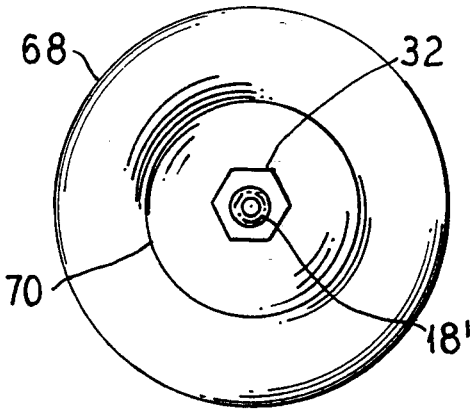
FIG. 7 is a bottom plan view of the horn shown in FIG. 6.

FIG. 7 is a bottom view of the system 1' of FIG. 6 without the horn 16 connected. The air inlet valve 18' is threadably secured substantially centrally in the base portion 68 of the recessed portion 70.

Figure 8:
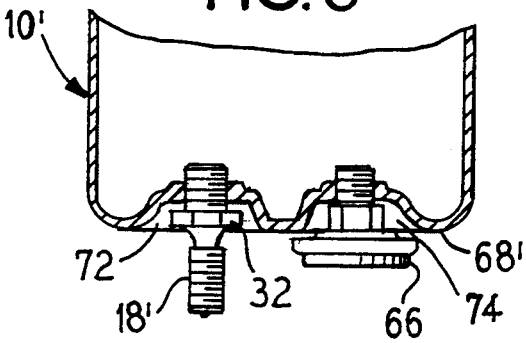
FIG. 8 is a cross-sectional view of another embodiment of the bottom portion of the horn shown in FIG. 7.
Figure 9:
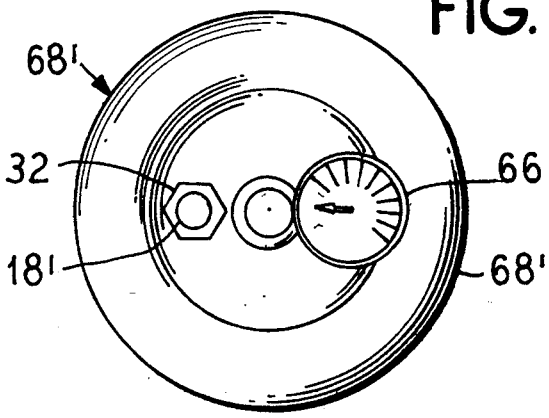
FIG. 9 is a bottom plan view of the bottom portion of the horn shown in FIG. 8.

In FIGS. 8 and 9, alternate embodiments of a base portion 68' are shown having two openings within two distinct recessed portions 72 and 74. The recessed portion 72 connects the air inlet valve 18', and the recessed portion 74 connects a pressure gauge 66 for monitoring air pressure within the chamber 10'.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus for initiating flow of pressurized air to produce a sound, the apparatus comprising:

a refillable pressurized air chamber for filling with said pressurized air, the chamber having a base end and a top end;

an adapter having a first opening connected to said chamber and a second opening in communication with said first opening defining a first passageway therebetween;

an inlet valve connected to the base end of the chamber;

an outlet valve within the adapter and connected to said second opening of said adapter and having a second passageway extending between said second opening and an opposite open end of said adapter;

an activator for releasing said pressurized air from said chamber and through said outlet valve of said adapter; and a horn intermediate said activator and said outlet valve of said adapter for receiving the pressurized air and producing the sound in response.

2. The apparatus of claim 1 wherein said first passageway is L-shaped.

3. The apparatus of claim 1 further comprising:

an activator unit separately housing said activator;

a lever within said activator unit pivotally fixed to depress said activator; and an actuator for forcing said lever to depress said activator.

4. The apparatus of claim 3 wherein said actuator is remotely mounted from the activator unit.

5. The apparatus of claim 3 wherein said activator unit, said horn, said chamber and said actuator are mounted on a bicycle.

6. The apparatus of claim 1 wherein said horn and said chamber are mounted on a bicycle.

7. The apparatus of claim 1 wherein said pressurized air is at least 40 psi.

8. The apparatus of claim 1 wherein the opposite open end of the inlet valve is connectable to an air pressure source.

9. An apparatus for initiating flow of pressurized air to produce a sound, said apparatus mounted to a frame of a bicycle comprising:

means for containing said pressurized air having a length defined between a base end and a top end;

means for receiving said pressurized air from said means for containing;

means for connecting said means for containing and said means for receiving at the top end of the means for containing;

means for directing sound having a length connected to said means for receiving such that the lengths of said means for containing and said means for directing are substantially parallel to each other;

means for activating said pressurized air operatively connected to said means for receiving; and means for refilling said means for containing after said pressurized air has been depleted therefrom, said means for refilling constructed and arranged at the base end of the means for containing.

10. The apparatus of claim 9 further comprising:

means for actuating operatively connected to said means for activating.

11. The apparatus of claim 10 wherein said means for actuating is mounted remotely from said means for activating.

12. The apparatus of claim 9 further comprising:

means for pumping said pressurized air through said means for refilling.

13. A method for producing sound comprising the steps of:

filling a container having a base end and a top end defining an interior therebetween with pressurized air;

providing a chamber at the top end of said container for receiving said pressurized air;

depressing an activator for releasing said air into said chamber thereby producing said sound;

refilling said container at the base end after said pressurized air has been at least partially depleted therefrom;

mounting said container and said chamber to a frame of a bicycle; and pressing an actuator remotely connected to said activator for releasing said air into said chamber.

14. The method of claim 13 wherein said refilling may be performed repetitively.

15. The method of claim 13 further comprising the step of:

mounting said actuator near handle bars of said bicycle for finger actuation thereof.

16. An apparatus for initiating flow of pressurized air to produce a sound, the apparatus comprising:

a refillable pressurized air chamber for filling with said pressurized air, the chamber having a base and a top defining open ends;

an inlet valve connected to the base, the inlet valve having an open end opposite the connection;

an outlet valve at the top of said chamber;

an activator for releasing said pressurized air from said chamber through said outlet valve; and a horn intermediate said activator and said outlet valve for receiving the pressurized air and producing the sound in response.

17. The apparatus of claim 16 further comprising:

a gauge connected to an additional opening of said chamber for monitoring pressure therein.

18. The apparatus of claim 16 wherein at least a portion of said inlet valve is removable from said chamber.

* * * * *